US006315891B1

(12) United States Patent
Richter et al.

(10) Patent No.: US 6,315,891 B1
(45) Date of Patent: Nov. 13, 2001

(54) PRODUCTION OF LUBRICANT BASE OILS

(75) Inventors: Ferdinand Richter, Hamburg (DE); Adrie Van Zyl Visser, Sasolburg; Godlieb Gerhardus Swiegers, Sedgefield, both of (ZA)

(73) Assignee: Schumann Sasol (South Africa) (Proprietary) Limited, Johannesberg (ZA)

( * ) Notice: Subject to any disclaimer, the term of this patent is extended or adjusted under 35 U.S.C. 154(b) by 0 days.

(21) Appl. No.: 09/203,062

(22) Filed: Dec. 1, 1998

(30) Foreign Application Priority Data

Dec. 3, 1997 (ZA) ..... 97/10868
Oct. 19, 1998 (ZA) ..... 98/9528

(51) Int. Cl.[7] ..... C10G 67/04

(52) U.S. Cl. ..... 208/96; 208/27; 208/108; 208/950

(58) Field of Search ..... 208/96, 108, 27, 208/950

(56) References Cited

U.S. PATENT DOCUMENTS

| | | | | |
|---|---|---|---|---|
| 3,365,390 | * | 1/1968 | Egan | 208/60 |
| 4,943,672 | * | 7/1990 | Hamner et al. | 208/27 |
| 5,059,299 | | 10/1991 | Cody et al. | 208/27 |
| 5,229,021 | | 7/1993 | Pillon et al. | 252/56 |
| 5,306,416 | | 4/1994 | Le et al. | 208/108 |
| 5,378,351 | | 1/1995 | Guichard et al. | 208/143 |

FOREIGN PATENT DOCUMENTS

| | | |
|---|---|---|
| 0574191 | 12/1993 | (EP) . |
| 0776959 | 6/1997 | (EP) . |
| 9721788 | 6/1997 | (WO) . |

* cited by examiner

*Primary Examiner*—Helane E. Myers
(74) *Attorney, Agent, or Firm*—Ladas & Parry

(57) ABSTRACT

A process for producing a waxy product comprises hydrotreating a feedstock comprising a Fischer-Tropsch wax and a petroleum-based waxy distillate, to produce a range of hydrogenated products, and recovering a waxy product from the range of hydrogenated products.

13 Claims, 1 Drawing Sheet

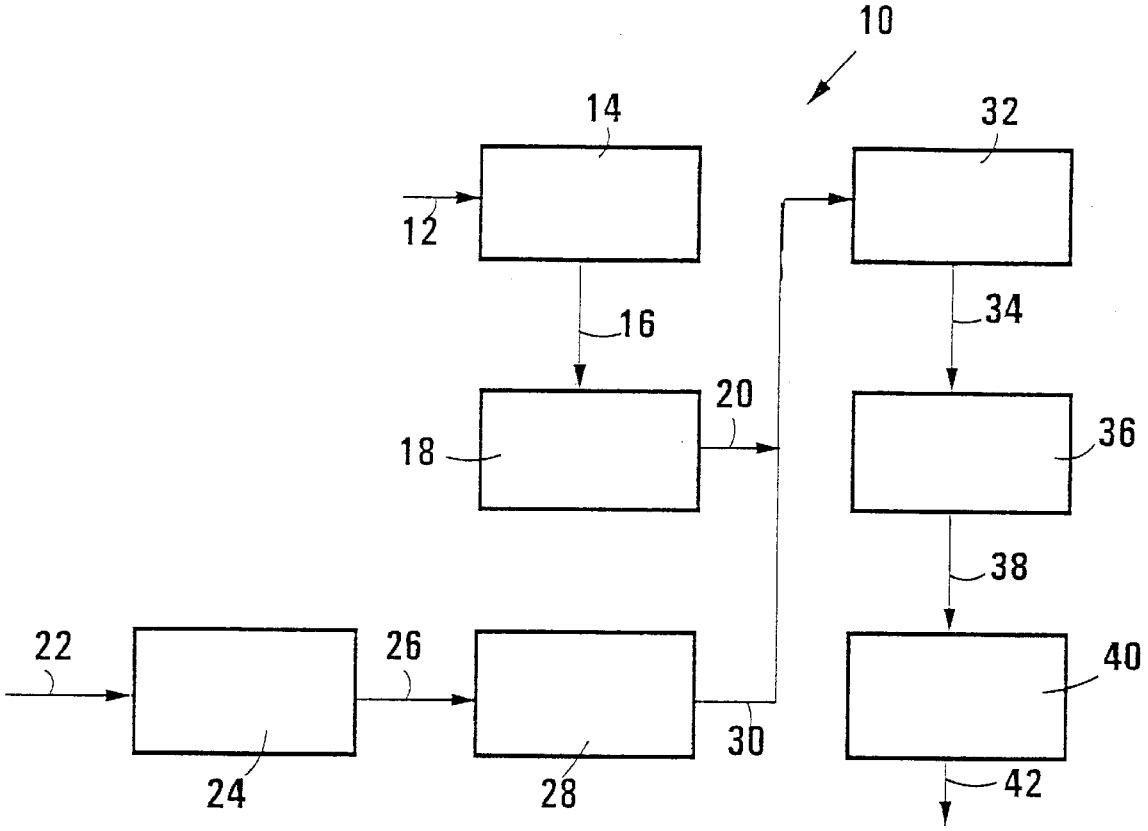
10
14
32
12
16
34
20
18
36
38
22
26
40
30
24
28
42

PRODUCTION OF LUBRICANT BASE OILS

THIS INVENTION relates to the production of lubricant base oils. It relates in particular to a process for producing a waxy product suitable for the production of lubricant base oils, and to a process for treating a waxy product to produce a dewaxed product suitable for use as a lubricant base oil.

According to a first aspect of the invention, there is provided a process for producing a waxy product, which process comprises hydrotreating a feedstock comprising a Fischer-Tropsch wax and a petroleum-based waxy distillate, to produce a range of hydrogenated products; and recovering a waxy product from the range of hydrogenated products.

By 'Fischer-Tropsch wax' is meant a wax obtained by the so-called Fischer-Tropsch process. The Fischer-Tropsch process includes converting a synthesis gas comprising mainly hydrogen and carbon monoxide, to hydrocarbons. The conversion is effected by contacting the synthesis gas with a Fischer-Tropsch catalyst, normally an iron or cobalt based catalyst, in a fixed bed or a slurry bed reactor under either low or high temperature Fischer-Tropsch operating conditions. In this manner, a mixture of hydrocarbons having different boiling ranges, is obtained. The Fischer-Tropsch wax is then recovered, eg by means of distillation, from this hydrocarbon mixture. The Fischer-Tropsch wax typically has a composition wherein about 80% by volume thereof has a boiling point higher than 550° C. atmospheric equivalent temperature ('AET'). Thus, for example, the Fischer-Tropsch wax may have an ASTM D2887 gas chromatography simulated distillation range in accordance with Table 1.

TABLE 1

| Fischer-Tropsch wax (simulated distillation according to ASTM D2887) | |
|---|---|
| % off (by volume) | ° C. |
| Initial boiling point | 430 |
| 10 | 510 |
| 30 | 570 |
| 50 | 610 |

The term 'petroleum-based waxy distillate' is known in the art. It thus means a waxy distillate obtained by physically separating a suitable crude oil using atmospheric and vacuum distillation. Suitable crude oils are so-called 'lube crudes'. Typically, the crude oil can be a Middle East crude oil, a North Sea crude oil, or an African crude oil. Thus, for example, the petroleum-based waxy distillate may have an ASTM D2887 gas chromatography simulated distillation range in accordance with Table 2.

TABLE 2

| Petroleum-based waxy distillate (simulated distillation according to ASTM D2887) | |
|---|---|
| % off (by volume) | ° C. |
| Initial boiling point | 255 |
| 10 | 344 |
| 30 | 397 |
| 50 | 432 |
| 70 | 463 |

TABLE 2-continued

| Petroleum-based waxy distillate (simulated distillation according to ASTM D2887) | |
|---|---|
| % off (by volume) | ° C. |
| 90 | 511 |
| Final boiling point | 579 |

The volumetric proportion of Fischer-Tropsch wax to petroleum-based waxy distillate in the feedstock may be between 5:95 and 50:50, preferably between 5:95 and 20:80.

The hydrotreatment may include hydrocracking the feedstock in a hydrocracking stage. The hydrocracking may be effected at a temperature of 300° C. to 410° C., preferably 350° C. to 400° C.; a pressure of 120–160 bar(g); a hydrogen partial pressure of 20–200 bar(g), preferably 100–175 bar (g); a hydrogen to liquid ratio of 200–2000:1 $m_n^3$, and a liquid hourly space velocity ('LHSV') of 0,2–2 $h^{-1}$.

The recovery of the waxy product from the range of hydrogenated products produced may include distilling, in a distillation stage, the range of hydrogenated products to obtain, as a bottoms fraction, the waxy product. Thus, typically, the products obtained from the distillation stage may be in accordance with Table 3.

TABLE 3

| Distillatian Stage | |
|---|---|
| Carbon range | Mass % |
| $C_1$–$C_4$ | 1–3 |
| $C_5$–$C_6$ | 4–6 |
| $C_7$–$C_{15}$ | 20–30 |
| $C_{15}$–$C_{28}$ | 35–40 |
| $C_{28}C_{40}$ | 15–25 |
| $C_{>40}$ | 5–15 |

The bottoms fraction, ie the $C_{>40}$ fraction, is thus the waxy product.

The bottoms fraction or waxy product from the distillation stage may then be subjected to dewaxing, eg solvent dewaxing, in a dewaxing stage, to recover a dewaxed product.

Thus, according to a second aspect of the invention, there is provided a process for treating a waxy product, which process comprises dewaxing, in a dewaxing stage, the waxy product obtained from the process according to the first aspect of the invention, to obtain a dewaxed product suitable for use as a lubricant base oil.

The dewaxing may comprise solvent dewaxing of the waxy product.

Preferred solvent combinations for dewaxing lube feedstocks such as waxy distillates, waxy raffinates, waxy hydrocracker residues and the corresponding distillate fractions are a methyl ethyl ketone/toluene ('MEK/T') and a dichloroethene/methylene chloride ('Di/Me'). This MEK/T or Di/Me can be used for dewaxing the waxy product; however, MEK/T is preferred.

The mass proportion of dichloroethene to methylenechloride in the MEK/T solvent is between 40:60 and 60:40, and may, for example, be about 50:50. The mass proportion of waxy product to solvent may be between 1:2 and 1:12, preferably between 1:3 and 1:10.

The dewaxing may comprise mixing the waxy product in liquid form with the MEK/T solvent; cooling the mixture to a sub-ambient dewaxing temperature, with solid wax crystals forming, and with the dewaxing temperature depending on the pour point which is required for the dewaxed product or the lubricant base oil; and separating, in a separation stage, the wax crystals from a mother liquor comprising dewaxed oil as the dewaxed product and spent solvent. The separation stage may, in particular, comprise a filter stage having at least one filter, eg a rotary filter, with the mother liquor or main filtrate thus passing through the filter and the solid wax crystals remaining as a wax cake on the filter. The process may include washing, in a washing step, the wax cake with fresh MEK/T mixture as a wash solvent, to obtain solvent free slack wax and spent solvent. The process may include recovering the spent solvent from the washing step and from the main filtrate, and recirculating or re-using the recovered solvent within the dewaxing stage. The recovery of the spent solvent may be effected by means of multistage distillation and stripping.

In the washing step, sufficient wash solvent may be used so that the mass proportion of waxy product initially used to wash solvent is between 1:1 and 1:2.

The dewaxing temperature may be between −5° C. and −32° C., for example between −12° C. and −27° C. The dewaxing temperature as set out hereinbefore, dependent on the pour point which is required for the resultant or corresponding lubricant base oil. For example, to produce a base oil with a pour point of −9° C., the corresponding dewaxing temperature is higher than the dewaxing temperature required to achieve a pour point of −18° C.

The dewaxed product thus obtained is suitable for use as a lubricant base oil, and the Applicant has surprisingly found that the lubricant base oil has a viscosity index ('VI') of 145 or higher, so that it is suitable for use as a super high viscosity index ('SHVI') lubricant base oil.

The invention naturally extends to a waxy product when produced by the process according to the first aspect of the invention, and to a dewaxed product, when produced by the process according to the second aspect of the invention.

According to a third aspect of the invention, there is provided a lubricant base oil which comprises a dewaxed product, as hereinbefore described.

According to a fourth aspect of the invention, there is provided a lubricant base oil which comprises a dewaxed waxy product obtained from the hydrotreatment of a feedstock comprising a Fischer-Tropsch wax and a petroleum based waxy distillate.

The lubricant base oil may thus have a VI of 145 or higher.

The invention will now be described by way of example with reference to the accompanying flow diagram of a process according to the invention for producing a dewaxed product, and with reference to the subsequent non-limiting example.

In the drawing, reference numeral 10 generally indicates a process according to the invention for producing a dewaxed product.

The process 10 includes a crude oil flow line 12 leading into an atmospheric distillation stage 14 comprising an atmospheric crude distillation tower. An atmospheric residue flow line 16 leads from the stage 14 to a vacuum distillation stage 18 comprising a vacuum distillation tower. A vacuum gas oil or waxy distillate flow line 20 leads from the vacuum distillation stage 18.

A synthesis gas flow line 22 leads into a Fischer-Tropsch reaction stage 24. The stage 24 comprises a fixed or slurry bed Fischer-Tropsch reactor operating under high or low temperature and using an iron-based or cobalt-based Fischer-Tropsch catalyst. A hydrocarbon flow line 26 leads from the stage 24 to a distillation stage 28 comprising at least one distillation tower. A Fischer-Tropsch wax flow line 30 leads from the distillation stage 28 to a hydrocracking stage 32 comprising a hydrocracker. The flow line 20 leads into the flow line 30.

A hydrocarbon product line 34 leads from the hydrocracking stage 32 to a distillation stage 36 comprising at least one distillation tower. A hydrocracker residue flow line 38 leads from the distillation stage 36 to a dewaxing stage 40. A dewaxed product withdrawal line 42 leads from the stage 40.

It will be appreciated that, in the process 10, only the most important, as regards the present invention, flow lines and processing stages are shown. In practice, ancillary reaction stages and additional flow lines will naturally be present. Thus, for example, prior to the crude oil line 12 entering the atmospheric distillation stage 14, it will typically pass through at least one heat exchanger stage, a desalting stage and a furnace. Additional flow lines which can be present are flow lines such as kerosine, diesel and atmospheric gas oil withdraw lines from the atmospheric distillation stage 14.

In use, the atmospheric distillation stage 14 and the vacuum distillation stage 18 are operated in conventional fashion to obtain a petroleum based waxy distillate which is withdrawn along the flow line 20. Similarly, the Fischer-Tropsch reaction stage 24 and the distillation stage 28 are operated in known fashion, to obtain a Fischer-Tropsch wax which is withdrawn along the flow line 30. The Fischer-Tropsch wax and the petroleum based waxy distillate are blended in a volumetric ratio between 5:95 and 20:80 to produce a feedstock which is fed into the hydrocracking stage 32. The hydrocracking stage 32 is typically operated at a temperature in the range 380° C. to 400° C.; a hydrogen partial pressure of 100–150 bar(g); a hydrogen liquid ratio of 750:1 to 1500:1 $m_n^3$; and a LHSV of 0,5–1 $h^{-1}$; to produce a range of hydrogenated products, which are withdrawn along the flow line 34 to the distillation stage 36.

In the distillation stage 36 the range of hydrogenated products are subject to distillation, to obtain, amongst others, a hydrocracker residue or bottoms fraction, ie a waxy product, which is withdrawn along the flow line 38. Typically, the distillation stage 36 comprises a 40 mm ID column with Sulzer (trademark) packing (about 650 mm high), operating under a vacuum of 5–10 mbar(a).

The hydrocracker residue or waxy product passes to the dewaxing stage or unit 40. In the dewaxing stage 40, the residue is mixed with a solvent comprising methyl ethyl ketone and toluene in a mass ratio of 50:50, with the mass ratio of residue to solvent being between 1:3 and 1:10. The resultant mixture is cooled to a sub-ambient dewaxing temperature which depends on the pour point which is required for the resultant dewaxed product or lubricant base oil. The solid wax crystals formed during cooling are separated, eg in rotary filters, from the main filtrate which comprises dewaxed oil, ie a dewaxed product, and spent solvent. The wax cake on the filter washed with a wash solvent comprising MEK/T in a 50:50 mass ratio. Spent solvent is separated from both the washed solid wax cake and the dewaxed residue, eg by means of multistage distillation and stripping. Sufficient wash solvent is used such that the mass ratio or proportion of waxy product or fresh feed to wash solvent is between 1:1 and 1:2. The dewaxing temperature is from −12° C. to −27° C. The dewaxed product is withdrawn along the flow line 42.

The Applicant has surprisingly found that the dewaxed product obtained from the process 10 can be used as a super high viscosity index ('SHVI') lubricant base oil having a viscosity index ('VI') of 145 and higher. Lubricant base oils are generally produced by physically separating crude oils ('lube crudes') using techniques such as distillation, solvent extraction and dewaxing processes. The products obtained are normally high viscosity index ('HVI') base oils having a VI in the range of about 95–105. The development of multigrade oils for the car industry necessitated the production of lubricant base oils with a significantly higher VI. Hydrocracking crude oil based waxy distillates resulted in significantly higher VI lubricant base oils. Since the early 1970's the lubricant industry has been using SHVI base oils, produced from hydrocracker residues. Hydrocracking, hydrogenation and hydro-isomerisation have been used to hydrotreat waxy distillates to produce base oils with a VI in the range of 120–135.

The dewaxed product obtained from the process 10 can thus be used as an SHVI lubricant base oil. It is well known that the VI of any lubricating oil is a function of its kinematic viscosity at 40° C. and its kinematic viscosity at 100° C. Therefore an increase in the VI of any lubricating oil is highly desired since it has the advantage of enabling the lubricating oil to be used over a wider temperature range.

It would have been expected to those skilled in the art that the highly paraffinic Fischer-Tropsch wax would easily crack to gasoline under conventional hydrocracking conditions. However, the Applicant has surprisingly found that the presence of aromatics in the petroleum based waxy distillate shields or protects the paraffin components in the Fischer-Tropsch wax from interacting with the hydrocracking catalyst.

The invention was illustrated by using analytical data of dewaxed hydrocracker residues produced with and without addition of Fischer-Tropsch wax to the hydrocracker feed as hereinafter described. An increase of 10–25 VI points, when Fischer-Tropsch wax has been added, shows the largely n-paraffinic Fischer-Tropsch wax conversion to hydrocarbons with a SHVI base oil quality.

A computer program, based on the fractionation of lube distillates from a full scale vacuum distillation unit, was developed to compare the yield structure of different commercially available hydrocracker residues. Calculations using the computer program showed that the addition of a Fischer-Tropsch wax to the waxy distillate resulted in an average of 10% of the hydrocracked products remaining unreacted and in the vacuum residue—not cracked or isomerised to lower boiling hydrocarbons. However, this vacuum residue wax can successfully be recycled to the hydrocracker feed. This is a further advantage and desired feature required for SHVI base oils, as cracking of the wax to lighter products would result in a higher VI base oil. The Applicant has therefore further surprisingly found that a hydrocracker residue derived from a combined feedstock of Fischer-Tropsch wax and a waxy distillate contains lubricant type hydrocarbons boiling at higher temperatures and having higher viscosities than lubricant oils produced from a 'pure' waxy distillate based hydrocracker residue, as is evident also from Table 3.

Ring structured hydrocarbons serve as solubilising agents for decomposition products which may be formed during the use of the finished lubricating oil. In blending a Fischer-Tropsch wax, which does not contain ring structured hydrocarbons with a petroleum-based waxy distillate, it was expected that the combination of Fischer-Tropsch wax and petroleum based waxy distillates would result in insufficient ring structured hydrocarbons in the resultant waxy product. However, it was surprisingly found that the dewaxed product contained sufficient ring-structured hydrocarbons to serve as solubilising agents for decomposition products which may form during the use of the finished lubricating oil.

The invention is further illustrated by the following non-limiting example.

EXAMPLE 1

A Fischer-Tropsch derived wax blended with a waxy distillate feedstock was hydrotreated in a hydrocracking process unit. The hydrocracking was done in a bench scale reactor, operating under the following conditions:

| | |
|---|---|
| Reaction temperature | 390° C.–395° C. |
| Hydrogen partial pressure | 140 bar(g) |
| Hydrogen: liquid ratio | 1200:1 $m_n^3$ |
| LHSV | 0.75 $h^{-1}$ |

The hydrocracking reactor was a fixed bed reactor. Hydrogen and liquid flow was from the bottom upwards. Liquid feed and hydrogen entering the reactor were preheated by passing through a layer of glass beads placed beneath the catalyst bed.

The reactor was electrically heated in three separately controlled zones with the preheat section in the bottom, and the catalyst section in the middle zone. Temperature measurement was done by means of five evenly spaced thermocouples inside the catalyst bed and a sixth couple inside the preheating zone.

The catalyst was presulphided in situ using $C_{11}$–$C_{13}$ paraffins spiked with dimethyl disulphide to yield a sulphur content of about 2,0%. During presulphidation the temperature was slowly increased up to 232° C. at a hydrogen pressure of 140 bar. The temperature was kept constant at 232° C. for a further two hours after which it was slowly increased to 315° C. The temperature was held at 315° C. for two hours before the feed was introduced and the temperature increased to the operating temperature of about 390° C.

The analysis of the hydrocracked hydrocarbons without the addition of a Fischer-Tropsch wax, ie petroleum-based waxy distillate on its own (Sample A) and with addition of a Fischer-Tropsch wax (Samples B and C) is summarised in Table 4.

TABLE 4

Analytical data of hydrocracked hydrocarbons

| | | Sample A | Sample B | Sample C |
|---|---|---|---|---|
| Feedstock | | | | |
| Waxy distillate | (vol %) | 100 | 90 | 90 |
| Fischer-Tropsch wax | (vol %) | 0 | 10 | 10 |
| Reactor temperature | (° C.) | 390 | 390 | 394.5 |
| Hydrocracked products | (kg/m³) | | | |
| Density @ 70° C. | (kg/m³) | 793.7 | 798.9 | 798.5 |
| Kinematic viscosity @ 100° C. | (mm²/s) | 4.569 | — | — |
| Flashpoint (PM) | (° C.) | 222 | 230 | 226 |
| Pour point | (° C.) | 36 | 45 | 48 |
| Wax | (%) | 17.4 | 31.5 | 27.1 |
| Simulated Distillation (ASTM 2887) | | | | |
| Initial boiling point | (° C.) | 379 | 376 | 373 |
| 2% | (° C.) | 386 | 383 | 382 |
| 5% | (° C.) | 392 | 390 | 389 |
| 10% | (° C.) | 398 | 397 | 396 |
| 30% | (° C.) | 417 | 422 | 420 |
| 50% | (° C.) | 435 | 453 | 448 |

TABLE 4-continued

Analytical data of hydrocracked hydrocarbons

| | | Sample A | Sample B | Sample C |
|---|---|---|---|---|
| 70% | (° C.) | 459 | 507 | 494 |
| 90% | (° C.) | 499 | >635 | 616 |
| 95% | (° C.) | 517 | | >635 |
| 98% | (° C.) | 534 | | |
| Final boiling point | (° C.) | 558 | | |
| Noack volatility (GLC) | (% wt) | 10.7 | 8.2 | 8.8 |

These results show clearly that the addition of 10% (by volume) of a Fischer-Tropsch wax to the lube waxy distillate, results in an increase of wax content in the corresponding hydrocracked bottoms. Also, the simulated distillation of the hydrocracked hydrocarbons shows that the blended samples produce hydrocarbons boiling above 635° C. which are not present in the hydrocarbons produced from the 'pure' waxy distillate. Solvent dewaxing was carried out on the hydrocracked hydrocarbons as follows:

After mixing the liquid waxy product with a solvent (MEK/T), the mixture was cooled down to a dewaxing temperature corresponding to a desired pour point of the resultant dewaxed product or lubricant base oil. The solid wax crystals which formed during cooling were separated from the main filtrate in rotary filters, and the wax cake on the filters washed with fresh Di/Me solvent, ie wash solvent. Solvent, from both the solvent containing wax and the main filtrate, was removed by a multistage distillation and stripping process to produce a solvent free slack wax from the wax and a dewaxed oil from the filtrate. The recovered solvent was recirculated within the dewaxing stage.

| Dewaxing conditions: | |
|---|---|
| Feed:solvent | 1:7 kg/kg |
| Feed:wash solvent | 1:2 kg/kg |
| Dewaxing temperature | −26° C. |

The analytical data of the dewaxed hydrocracked products is shown in Table 5.

TABLE 5

Solvent dewaxed hydrocracked products

| | | Sample A | Sample B | Sample C |
|---|---|---|---|---|
| Feedstock to hydrocracking | | | | |
| Waxy distillate | (%) | 100 | 90 | 90 |
| Fischer-Tropsch wax | (%) | 0 | 10o | 10 |
| Hydrocracking reactor temperature | (° C.) | 390 | 390 | 394.5 |
| Dewaxed hydrocracked products | | | | |
| Density @ 70° C. | (kg/m$^3$) | 796.5 | 797.0 | 797.8 |
| Kinematic viscosity @ 40° C. | (mm$^2$/s) | 21.34 | 24.76 | 23.52 |
| Kinematic viscosity @ 100° C. | (mm$^2$/s) | 4.608 | 5.195 | 4.988 |
| VI | | 135.4 | 146.3 | 143.1 |
| Pour point | (° C.) | −15 | −15 | −15 |
| Yield | (% wt) | 82.6 | 68.5 | 72.9 |

As indicated hereinbefore, to compare the yield structure of different commercially available hydrocarbon residues, a computer program, which takes into account the fractionation of lube distillates from a full scale vacuum distillation unit, was used.

Table 6 shows, as determined by the computer programme, the change in lubricant distillate distribution by addition of Fischer-Tropsch wax to the hydrocracker feed (sample B and C) in comparison to the distillate distribution of a hydrocracker residue produced with 'pure' waxy distillate (sample A).

TABLE 6

Lubricant distillate distribution

| | Sample A | Sample B | Sample C |
|---|---|---|---|
| Dewaxed hydrocracked products | | | |
| Fraction 1 | 0 | 0 | 0 |
| Fraction 2 | 27.8 | 27.2 | 27.2 |
| Fraction 3 | 29.0 | 22.2 | 22.1 |
| Fraction 4 | 28.1 | 20.9 | 21.1 |
| Fraction 5 | 15.1 | 16.4 | 16.6 |
| Vacuum residue | 0 | 13.3 | 12.9 |

SHVI base oils which can be produced by the present invention are summarised in Table 7.

TABLE 7

SHVI base oil properties

| | | Sample A | Sample B | Sample C |
|---|---|---|---|---|
| Basic Grade HC4 | | | | |
| Kinematic viscosity @ 40° C. | (mm$^2$/s) | 17.16 | 16.04 | 16.4 |
| Kinematic viscosity @ 100° C. | (mm$^2$/s) | 3.97 | 3.8 | 3.85 |
| VI | | 130.6 | 130.5 | 129.8 |
| Pour point | (° C.) | −15 | −15 | −15 |
| Noack volatility (GC) | (% wt) | 15.5 | 15.5 | 15.5 |
| Yield | (% wt) | 60 | 50 | 50 |
| Basic Grade HC6 | | | | |
| Kinematic viscosity @ 40° C. | (mm$^2$/s) | 31.35 | 32.36 | 32.68 |
| Kinematic viscosity @ 100° C. | (mm$^2$/s) | 5.97 | 6.3 | 6.3 |
| VI | | 138.8 | 149 | 146.6 |
| Pour point | (° C.) | −15 | −15 | |
| Noack volatility (GC) | (% wt) | 6.5 | 6.5 | 6.5 |
| Yield | (% wt) | 40 | 30 | 28 |
| Vacuum gas oil - Yield | (% wt) | — | — | 4 |
| Vacuum residue - Yield | (% wt) | — | 20 | 18 |

Two types of SHVI base oils are typically produced:
* HC4 Kinematic viscosity @ 100° C. 4 mm$^2$/s
* HC6 Kinematic viscosity @ 100° C. 6 mm$^2$/s These base oils are produced by vacuum distillation of the corresponding hydrocracker residue. The HC6 oil produced with the Fischer-Tropsch wax addition is of a significantly higher VI (>145). In the above example there is no difference in the VI on HC4 base oils produced as the corresponding n-paraffins were not added to the waxy distillate blend. However, it was surprisingly found that SHVI base oils produced by this feed combination to the hydrocracker, have a higher VI (10 to 25 points) than hydrocracked base oils produced from waxy distillates only.

What is claimed is:

1. A process for producing a waxy product, which process comprises hydrocracking a feedstock comprising a Fischer- Tropsch wax and a petroleum-based waxy distillate, with the volumetric proportion of Fischer-Tropsch wax to petroleum-based waxy distillate in the feedstock being between 5:95 and 50:50, to produce a range of hydrogenated products; and recovering a waxy product from the range of hydrogenated products.

2. A process according to claim 1, wherein the volumetric proportion of Fischer-Tropsch wax to petroleum based waxy distillate in the feedstock is between 5:95 and 20:80.

3. A process according to claim 1, wherein the hydrotreatment includes hydrocracking the feedstock in a hydrocracking stage at a temperature of 350° C. to 400° C.; a pressure of 120–160 bar(g); a hydrogen partial pressure of 100–175 bar(g); a hydrogen to liquid ratio of 200–2000:1 $m_n^3$, and a liquid hourly space velocity ('LHSV') of 0,2–2 $h^{-1}$.

4. A process according to claim 1, wherein the recovery of the waxy product from the range of hydrogenerated products produced includes distilling, in a distillation stage, the range of hydrogenated products to obtain, as a bottoms fraction, the waxy product.

5. A process for producing and treating a waxy product, which process comprises hydrocracking a feedstock comprising a Fischer-Tropsch wax and a petroleum-based waxy distillate, with the volumetric proportion of Fischer-Tropsch wax to petroleum-based waxy distillate in the feedstock being between 5:95 and 50:50, to produce a range of hydrogenated products; recovering a waxy product from the range of hydrogenated products; and dewaxing, in a dewaxing stage, the waxy product, to obtain a dewaxed product suitable for use as a lubricant base oil.

6. A process according to claim 5, wherein the dewaxing of the waxy product comprises contacting the waxy product with a dichloroethene/methylenechloride mixture ('Di/Me') as a solvent.

7. A process according to claim 6, wherein the mass proportion of dichloroethene to methylenechloride in the Di/Me solvent is between 40:60 and 60:40, and wherein the mass proportion of waxy product to solvent is between 1:2 and 1:12.

8. A process according to claim 7, wherein the mass proportion of waxy product to solvent is between 1:3 and 1:10.

9. A process according to claim 6, wherein the dewaxing comprises mixing the waxy product in liquid form with the Di/Me solvent; cooling the mixture to a sub-ambient dewaxing temperature, with solid wax crystals forming, and with the dewaxing temperature depending on the pour point which is required for the dewaxed product or the lubricant base oil; separating, in a filter stage, the wax crystals from a main filtrate comprising dewaxed oil as the dewaxed product, and spent solvent so that the solid wax crystals remain as a wax cake on the filter; and washing, in a washing step, the wax cake with fresh Di/Me mixture as a wash solvent, to obtain solvent free slack wax and spent solvent.

10. A process according to claim 9, which includes recovering the spent solvent from the washing step and from the main filtrate, and recirculating the recovered solvent within the dewaxing stage.

11. A process according to claim 9, wherein, in the washing step, sufficient wash solvent is used so that the mass proportion of waxy product initially used to wash solvent is between 1:1 and 1:2.

12. A process according to claim 9, wherein the dewaxing temperature is from −5° C. to −32° C.

13. A process for producing a waxy product, said process consisting essentially of:

(a) providing a feedstock comprising a Fischer-Tropsch wax and a petroleum-based waxy distillate, wherein a volumetric proportion of the Fischer-Tropsch wax to the petroleum-based waxy distillate in the feedstock is between 5:95 and 50:50;

(b) hydrocracking the feedstock to produce a range of hydrogenated products;

and (c) recovering the waxy product from the range of hydrogenated products.

* * * * *